US010781812B2

(12) United States Patent
Jackson et al.

(10) Patent No.: US 10,781,812 B2
(45) Date of Patent: Sep. 22, 2020

(54) COMPRESSOR PROVIDED WITH SAFETY RELIEF VALVE ASSEMBLY

(71) Applicant: Valeo North America, Inc., Troy, MI (US)

(72) Inventors: Robert Jackson, Lake Orion, MI (US); Yei-Hsine Chuang, Troy, MI (US)

(73) Assignee: Valeo North America, Inc., Troy, MI (US)

( * ) Notice: Subject to any disclaimer, the term of this patent is extended or adjusted under 35 U.S.C. 154(b) by 248 days.

(21) Appl. No.: 15/966,517

(22) Filed: Apr. 30, 2018

(65) Prior Publication Data

US 2019/0331108 A1 Oct. 31, 2019

(51) Int. Cl.

| | |
|---|---|
| ***F04B 49/03*** | (2006.01) |
| ***F04B 49/22*** | (2006.01) |
| ***F04B 39/10*** | (2006.01) |

(52) U.S. Cl.

CPC ..... *F04B 49/03* (2013.01); *F04B 39/10* (2013.01); *F04B 49/22* (2013.01)

(58) Field of Classification Search

CPC ..... F04B 39/10; F04B 49/03; F04B 49/22

See application file for complete search history.

(56) References Cited

U.S. PATENT DOCUMENTS

| | | | | |
|---|---|---|---|---|
| 5,794,915 | A | 8/1998 | Shimizu et al. | |
| 6,796,321 | B2 * | 9/2004 | Vicars | F16K 17/02 137/467 |
| 9,062,786 | B2 * | 6/2015 | Inoue | F04B 39/10 |

FOREIGN PATENT DOCUMENTS

| | | |
|---|---|---|
| JP | H07-004357 A | 1/1995 |
| JP | 2011043094 A | 3/2011 |

* cited by examiner

*Primary Examiner* — Charles G Freay

(74) *Attorney, Agent, or Firm* — Osha Liang LLP

(57) ABSTRACT

A compressor of the present invention has a blocking portion for preventing a refrigerant containing an inflammable component such as lubricating oil ejected from an ejection port of a safety relief valve from being ejected to a specific direction where a drive belt, an electromagnetic clutch, an exhaust manifold, and placed. The blocking portion is not separately attached but is integrally formed with a housing member by using the same material as that thereof, and is disposed on a line in an ejection direction of the ejection port. The present invention can provide a compressor excellent in productivity, durability, and safety without increasing the number of manufacturing processes or causing, for example, rotation failure of the drive belt and a pulley for driving the compressor and its auxiliaries and an occurrence of white smoke due to a contact between the exhaust manifold at high temperatures and the refrigerant.

14 Claims, 13 Drawing Sheets

COMPRESSOR PROVIDED WITH SAFETY RELIEF VALVE ASSEMBLY

BACKGROUND OF THE INVENTION

1. Field of the Invention

The present invention relates to a compressor having a component disposed to block a refrigerant containing lubricating oil ejected from a safety relief valve included in a compressor for use in an automotive air conditioning system.

2. Description of the Related Art

A compressor generally has a safety relief valve which discharges high-pressure inner fluid to the outside to mitigate internal pressure when the internal pressure exceeds a predetermined value. In this safety relief valve, particularly in the case of a compressor using an internal-combustion engine in an automotive air conditioning system, a refrigerant containing an inflammable component such as lubricating oil ejected from the safety relief valve of the compressor may enter a space between a drive belt and a pulley for driving the compressor and its auxiliaries to cause rotation failure or between an armature plate and the pulley configuring an armature assembly to cause engagement failure. Moreover, several types of heat sources such as a turbo charger, an exhaust manifold, and electrified units may be placed around the compressor. If the lubricating oil included in the refrigerant make contact with such components at high temperature, it may cause white smoke.

To address these problems, components which guide the refrigerant containing the inflammable component such as lubricating oil ejected from the safety relief valve to a specific direction have been disclosed.

For example, Kawamura discloses in JPA 1995004357 a cap formed of a resin material without a gap, and a removable component provided with an engaging unit which is elastically deformed when attached to an outer wall of a safety relief valve, a rotation restricting unit which fixes the cap in a space between the cap and the outer wall of the safety relief valve, and a guide unit which guides a refrigerant containing a flammable component such as lubricating oil ejected from the safety relief valve to one direction.

Shimizu also discloses in U.S. Pat. No. 5,794,915 that a safety relief valve assembly for use in a fluid displacement apparatus of an automotive air conditioning system includes a valve mechanism which releases gas when the pressure in the fluid displacement apparatus increases above a predetermined pressure level. This assembly is detachably mounted on the valve mechanism to direct the flow of the gas in a predetermined direction and is composed of a control device and an elastic member. This elastic member is forcibly disposed between the valve body and the control device, and includes a groove facing the relief port of the valve body such that the groove and the valve body collectively form a passage for directing the excessive refrigerant gas.

Watanabe discloses in JPA 2011043094 an attachment bracket fixed at a position facing a safety relief valve to guide a refrigerant ejected from the safety relief valve to a desired direction. This attachment bracket is formed by molding of resin or a metal material, and includes an attachment unit to be fixed to an attachment boss of a rear housing with a fixing bolt, a first binding wall connected to an end of the attachment unit substantially at a right angle and extending downward, a second binding wall horizontally extending with respect to the attachment unit and then bent downward substantially at a right angle to extend, a guide unit bound to an end of the first binding wall and covering above the safety relief valve to guide the refrigerant ejected from the safety relief valve to a desired direction, and a sensor attachment unit bound to an end of the second binding wall. The binding walls and the guide unit each have a bead formed thereon.

However, the above-mentioned arrangement requires a process for attaching the bracket on the compressor in an appropriate manner, and determining an attachment direction is difficult. Thus, an inspection process has to be added to confirm that attachment has been completed without error.

Also, while resin is used to prevent leakage of the refrigerant, facilitate attachment and detachment, and allow reliable fixation, oil resistance and durability are low with respect to the refrigerant containing an inflammable component such as lubricating oil. To address this problem, for example, as described in JPA 1995004357, FRP (Fiber Reinforced Plastics) of nylon and glass fiber as an engineering plastic or the like has to be applied, thereby disadvantageously making molding more difficult and expensive compared with metal.

On the other hand, the attachment bracket has an intricate structure and molding difficulty, and is also expensive. In addition, the attachment bracket requires a more complicated attachment process than that of a cap using a bolt. Thus, overall productivity is disadvantageously quite low.

SUMMARY OF THE INVENTION

An object of the present invention is to provide a compressor excellent in productivity, durability, and safety. In the compressor, a blocking portion to prevent ejection of a refrigerant containing an inflammable component such as lubricating oil from a safety relief valve to a specific direction is not separately attached but can be integrally molded with a housing of the compressor. Also, the compressor can prevent, for example, rotation failure of a drive belt and a pulley for driving the compressor and its auxiliaries, engagement failure between an armature plate and the pulley, and occurrence of white smoke due to a contact between an exhaust manifold at high temperatures and the refrigerant.

The compressor of the present invention includes a compression mechanism capable of compressing a working fluid as a refrigerant or the like, the compression mechanism being driven by motive power from an internal-combustion mechanism of an automobile, vehicle, or others, by an electric motor, or by motive power from a hybrid engine, a low-pressure region directly or indirectly connected to the compression mechanism and supplied with the working fluid, a high-pressure region directly or indirectly connected to the compression mechanism, the high-pressure region being a space to which the working fluid is discharged, a housing having a plurality of housing members, having directly or indirectly accommodated therein the compression mechanism, the low-pressure region, and the high-pressure region, and forming a space which allows the working fluid to be accommodated therein, a safety relief valve provided to at least one of the plurality of housing members, having an ejection port, and allowing the working fluid accommodated in the space formed by the at least one of the plurality of housing members to be released to the outside of the housing toward at least one ejection direction from the ejection port, and a blocking portion having a surface disposed opposite to be opposed to the ejection direction or a surface disposed so as to form a predetermined angle with respect to the ejection direction.

When a pressure in the space formed by housing members including the housing member to which the safety relief valve is provided exceeds a predetermined value, the working fluid accommodated in the space is ejected from the ejection port of the safety relief valve to the outside of the housing together with lubricating oil. However, when the working fluid is ejected to a specific direction in the engine room of a vehicle, troubles may occur such that the working fluid enters between the drive belt and the pulley for driving the compressor as well as other components such as an alternator to cause rotation failure or enters between the armature plate and the pulley to cause engagement failure. Moreover, a trouble may occur such that the working fluid makes contact with the high-temperature components such as an exhaust manifold to cause white smoke. In a compressor of the present invention, a working fluid containing lubricating oil ejected from an ejection port of a safety relief valve provided on one of the housing members is prevented from being ejected toward unfavorable directions by a blocking portion.

To achieve means to solve the above troubles without degrading productivity or durability, the blocking portion of the compressor of the present invention is disposed on the housing. In particular, the blocking portion is preferably integrally formed with any one of the housing members by using a material identical to a material of the housing member, in particular, aluminum or an aluminum alloy.

The safety relief valve of the compressor of the present invention is preferably attached to a housing member different from the housing member where the blocking portion is formed.

The compressor of the present invention preferably further includes a mount portion for attaching the compressor, the mount portion integrally formed with any one of the plurality of housing members by using the material identical to the material of the housing member, and the mount portion can function as the blocking portion. The blocking portion is more preferably formed as a part of the mount portion. To be formed as a part of the mount portion, the blocking portion may be externally or internally provided to the mount portion.

Furthermore, the compressor of the present invention preferably further includes a mount portion for attaching the compressor, the mount portion integrally formed with any one of the plurality of housing members by using a material identical to a material of the housing member, and a gripping portion on the mount portion to grip the compressor, and the gripping portion can function as the blocking portion. The blocking portion is more preferably internally provided to the gripping portion.

As described above, the blocking portion of the compressor of the present invention is integrally formed by using the same material as that of the housing. Thus, unlike a conventional cap or bracket, an attachment process and an inspection process are not required, and productivity is excellent. Moreover, since the blocking portion of the compressor of the present invention is formed by using the same material as that of the housing, the blocking portion is excellent in reliability compared with resin, and can be manufactured at low cost.

To effectively solve the problems of rotation failure and/or engagement failure due to diffusion of the working fluid containing lubricating oil to a vehicle's specific direction and the problem of white smoke due to dissipation of the working fluid toward the high-temperature components, the blocking portion of the compressor of the present invention is preferably formed as a plate member substantially as a whole which crosses a line in the ejection direction. More preferably, a distance between the ejection port and the blocking portion on a line in the ejection direction is substantially 2 mm to substantially 50 mm. Still more preferably, the blocking portion has a concave part formed at a portion which faces the ejection port or a groove part formed to include the portion which faces the ejection port.

In any case of the above, the working fluid containing lubricating oil ejected from the ejection port of the safety relief valve of the compressor of the present invention is more reliably captured by the blocking portion. This allows diffusion to the front of the compressor to be more reliably prevented, and also can increase the amount of precipitation of lubricating oil due to a collision of the working fluid containing lubricating oil with the blocking portion and can decrease the concentration of the working fluid containing lubricating oil diverging to the rear of the compressor.

BRIEF DESCRIPTIONS OF THE DRAWINGS

Figure 12:
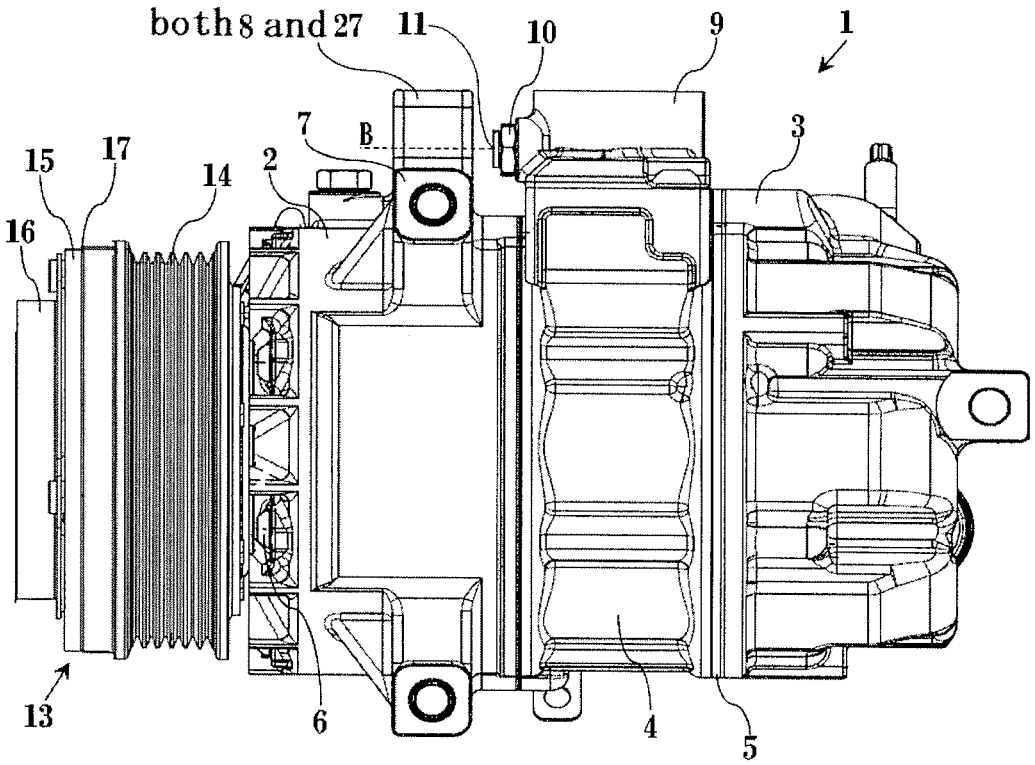
Figure 13:
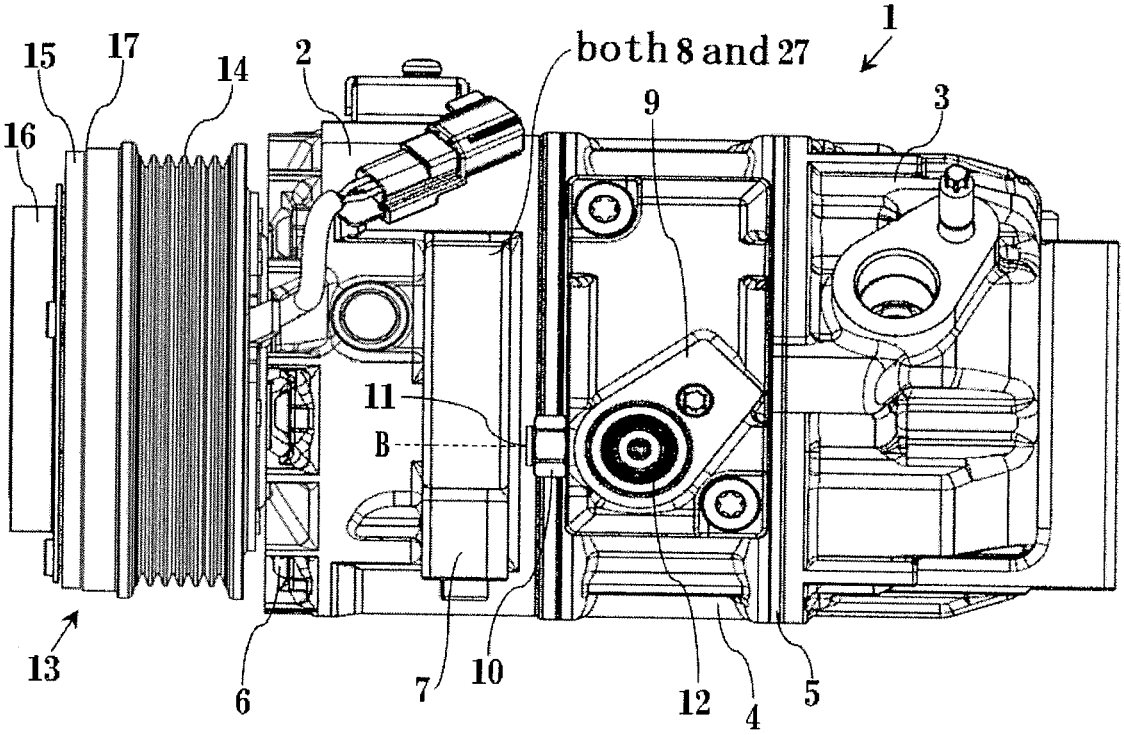

FIG. 12 is a schematic side view of a swash plate compressor formed so that a gripping portion which grips the compressor on a compressor-attachment mount portion serves also as a blocking portion, according to one embodiment of the present invention; and FIG. 13 is a schematic plan view of the swash plate compressor formed so that a gripping portion which grips the compressor on a compressor-attachment mount portion serves also as a blocking portion, according to one embodiment of the present invention.

DETAILED DESCRIPTIONS OF THE INVENTION

Various embodiments are described in detail below by using the drawings and taking a swash plate compressor as a specific example. However, the present invention is not limited to these embodiments but is limited only by the technical idea described in the claims, and includes all techniques subsumed under the claims.

Figure 1:
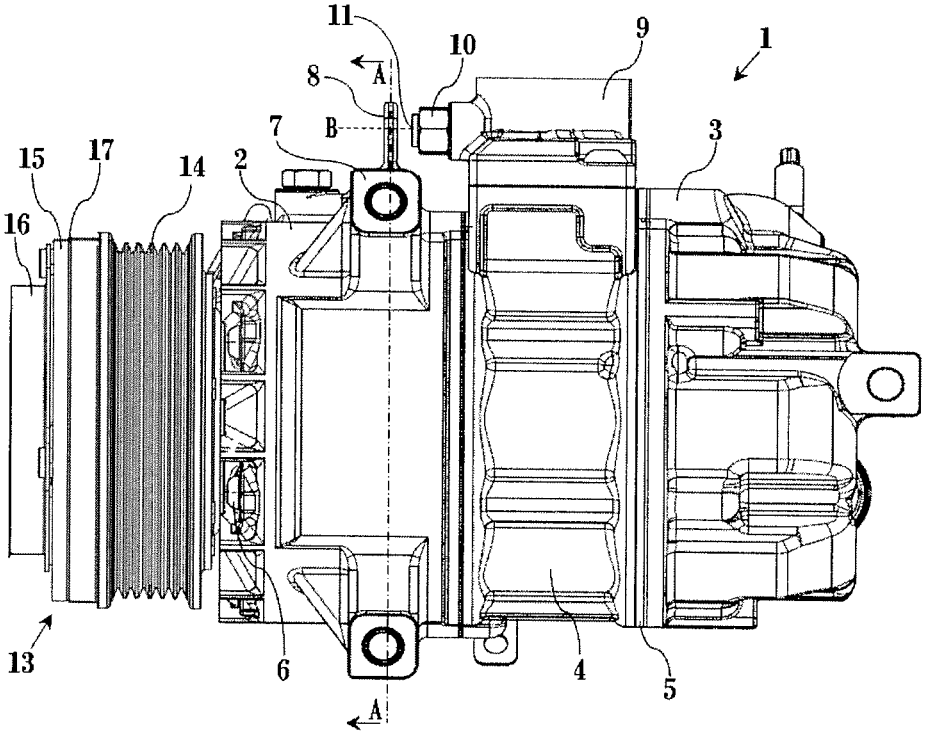
FIG. 1 is a schematic side view of a swash plate compressor formed to have a plate member as a blocking portion externally provided to a part of a compressor-attachment mount portion, according to one embodiment of the present invention.
Figure 2:
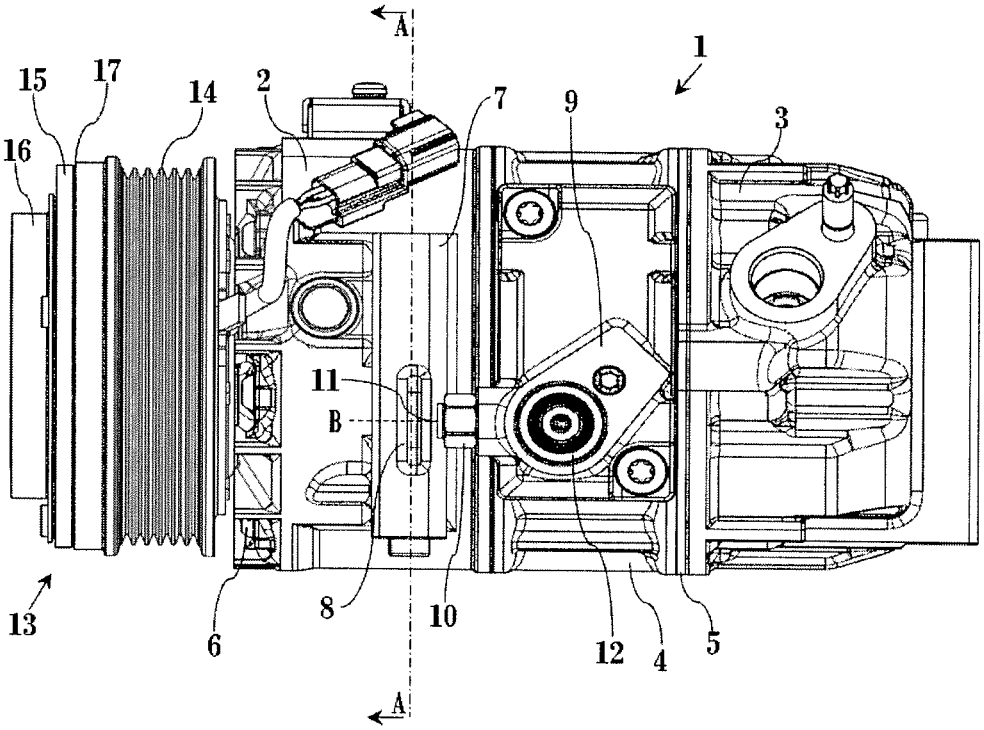
FIG. 2 is a schematic plan view of the swash plate compressor formed to have a plate member as a blocking portion externally provided to a part of a compressor-attachment mount portion, according to one embodiment of the present invention.
Figure 3:
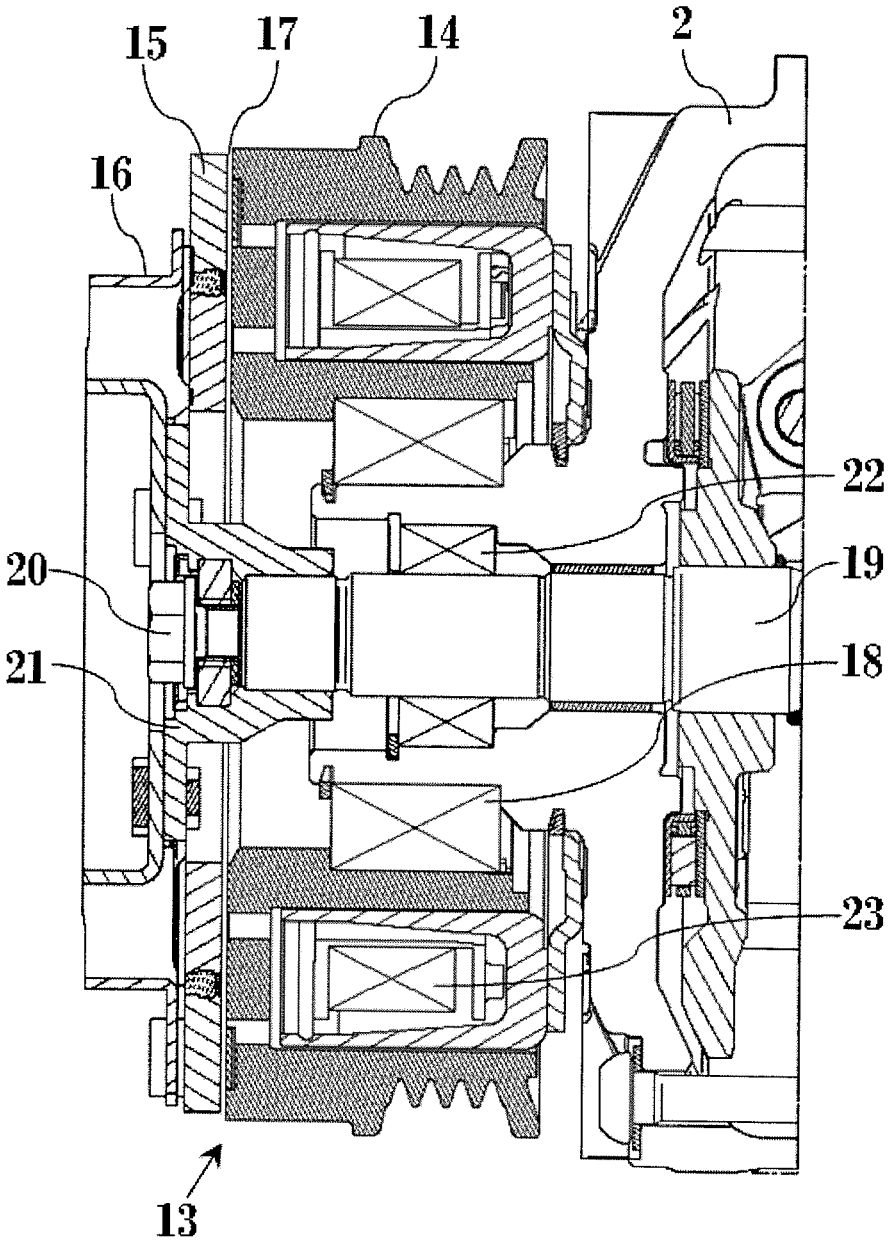
FIG. 3 is a schematic sectional view of an electromagnetic clutch of the swash plate compressor depicted in FIG. 1 and FIG. 2, the electromagnetic clutch configured of a pulley, a field coil, and an armature assembly, according to one embodiment of the present invention.
Figure 4:
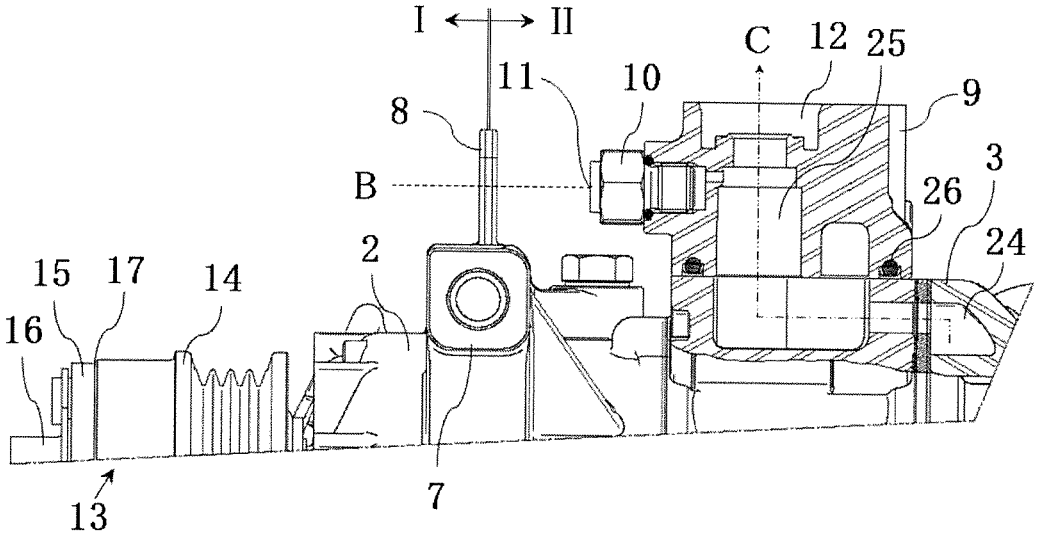
FIG. 4 is a schematic sectional view of a portion of the swash plate compressor depicted in FIG. 1 and FIG. 2 near a safety relief valve and the blocking portion, according to one embodiment of the present invention.

FIG. 1 is a schematic side view of a swash plate compressor 1 formed to have a plate member as a blocking portion 8 externally provided to a part of a compressor-attachment mount portion 7, according to one embodiment of the present invention, and FIG. 2 is a plan view thereof. FIG. 3 is a schematic sectional view of an electromagnetic clutch 13 of the swash plate compressor 1 depicted in FIG. 1 and FIG. 2, the electromagnetic clutch 13 configured of a pulley 14, a field coil 23, and an armature assembly 16. FIG. 4 is a schematic sectional view of a portion of the swash plate compressor 1 depicted in FIG. 1 and FIG. 2 near a safety relief valve 10 and the blocking portion 8.

The swash plate compressor 1 according to one embodiment of the present invention comprises a front housing 2, a rear housing 3, a cylinder block 4 in which cylinder bores are formed (not depicted), and a cover 9. The rear housing 3 is assembled onto a rear side (right side in the figure) of the cylinder block 4 via a valve plate 5, and the front housing 2 is fastened in an axial direction with a fastening bolt 6 so as to close a front side (left side in the drawing) of the cylinder block 4. Further a cover 9 is assembled on the cylinder block 4 to form a muffler chamber 25 therebetween. Therefore, these housing members configure a housing which delimits spaces for working fluids such as refrigerant and/or lubrication oil as well as mechanical parts such as a compression mechanism, which will be described below. This swash plate compressor 1 is fixed to a vehicle via the compressor-attachment mount portion 7.

The above-configured swash plate compressor 1 has a swash plate compression mechanism (not depicted) as the compression mechanism accommodated therein. With this compression mechanism and the cylinder block 4, a refrigerant suctioned from a suction chamber (not depicted) is compressed, is discharged to a discharge chamber 24, which will be described further below, and is then supplied to a refrigeration cycle (not depicted).

The above-described compression mechanism is driven by the electromagnetic clutch 13 described below transmitting motive power of a vehicle engine. FIG. 3 is a schematic sectional view of the electromagnetic clutch 13 on a front side end of the swash plate compressor 1 depicted in FIG. 1 and FIG. 2. As depicted in FIG. 3, an externally-and-rotatably-fitting pulley 14 is attached to the electromagnetic clutch 13. A hub 21 is attached at a tip of a shaft 19 protruding from the front housing 2 with a bolt 20. To the hub 21, a magnetic armature plate 15 is attached so as to be opposed to an end face of the pulley 14 via a predetermined clearance. Furthermore, the field coil 23 is disposed inside the pulley 14. With the field coil 23 energized, a magnetic force occurs, and the armature plate 15 is pulled to and engaged with the drive pulley 14. This engagement causes transmission of the rotation motive power transferred to the pulley 14 from an engine of a vehicle via a belt to the shaft 19. The rotation of the shaft 19 is transmitted to a swash plate (not depicted) provided thereon thus causing wobbling motion of the swash plate. The wobbling motion of the swash plate is converted into reciprocation motion of pistons (not depicted) in the cylinder bores of the cylinder block 4. According to the reciprocation motion of the piston in the cylinder bore, a refrigerant is sucked into the cylinder bore via a suction hole (not depicted) formed on the valve plate 5 from the suction chamber, and compressed in the cylinder bore. The suction chamber configures the low-pressure region.

A compressed refrigerant generated by the compression mechanism driven in the above-described manner and the cylinder block 4 is supplied to the refrigeration cycle as follows. FIG. 4 depicts a schematic sectional view of a portion of the swash plate compressor 1 depicted in FIG. 1 and FIG. 2 near the safety relief valve 10 and the blocking portion 8. In the rear housing 3, the discharge chamber 24 from which the compressed refrigerant is discharged is defined and formed. The cylinder block 4 and the cover 9 having the discharge muffler chamber 25 defined and formed therein are hermetically bound together via an O ring 26. The refrigerant discharged into the discharged chamber 24 flows into the discharge muffler chamber 25 through holes (not numbered) provided in the valve plate 5 and the cylinder block 4. Further, a discharge port 12 from which the refrigerant is supplied to the refrigeration cycle is provided at an upper end of the cover 9. The discharge chamber 24, the holes, and the discharge muffler chamber 25 configure the high-pressure region.

The safety relief valve 10 for mitigating excessive pressure when the pressure increases to become a predetermined pressure or more is required to be provided on one of the housing members which accommodates a space of the high-pressure region. More specifically, the safety relief valve 10 is provided at a predetermined position near the discharge port 12 of the cover 9 for the sake of safety because the temperature and pressure in the compressor 1 dramatically change depending on the driving conditions of the vehicle and an air conditioner and weather conditions. However, from the safety relief valve 10, the refrigerant and also lubricating oil for smoothly driving the swash plate compressor 1 are ejected from an ejection port 11 of the safety relief valve 10. When ejected from the ejection port 11 of the safety relief valve 10 to a specific direction, for example, the refrigerant with the lubricating oil and so forth may enter a space between the drive belt which drives the compressor 1 and the pulley 14 to cause rotation failure and a space between the armature plate 15 and the pulley 14 to cause engagement failure. Furthermore, a contact with the exhaust manifold at high temperatures may produce white smoke to cause a trouble, and may serve as a cause for an uncomfortable smell if diffused inside the vehicle, thereby destroying a comfortable vehicle interior space.

The present invention provides a vehicle compressor including that of a swash plate type to solve the above-described problems by disposing the blocking portion 8 at a position crossing a direction line B in which the refrigerant containing lubricating oil is ejected from the ejection port 11 of the safety relief valve 10 so as to block that refrigerant. Preferably, the angle between a plane defined by the surface of the blocking portion 8 opposed to the safety relief valve 10 and the direction line B is approximately 90 deg. The ejection port 11 of the safety relief valve 10 and the blocking portion 8 may be arranged at any positions where the above-described positional relation is kept. However, basically in the embodiments of the present invention described in the following, as preferred means for solving the above-described problems, the ejection port 11 of the safety relief valve 10 is arranged at a position so that the direction in which the refrigerant containing lubricating oil is ejected is the same as the direction of the drive belt, pulley, the electromagnetic clutch, and the exhaust manifold at high temperatures, and the blocking portion 8 which blocks the refrigerant is arranged at a position crossing the direction line B in which the refrigerant is ejected.

In the swash plate compressor 1 including the safety relief valve 10 and the blocking portion 8 having the above-described positional relation, the refrigerant containing lubricating oil collides with the blocking portion 8 to precipitate the lubricating oil, thereby preventing the refrigerant containing lubricating oil from being ejected to a I direction in which the drive belt, the pulley, and the electromagnetic clutch are provided. Also, the concentration of the refrigerant containing lubricating oil diverging to a II direction in the rear of the compressor where the exhaust manifold is provided can be extremely decreased. These can effectively solve the above-described problems.

Figure 5:
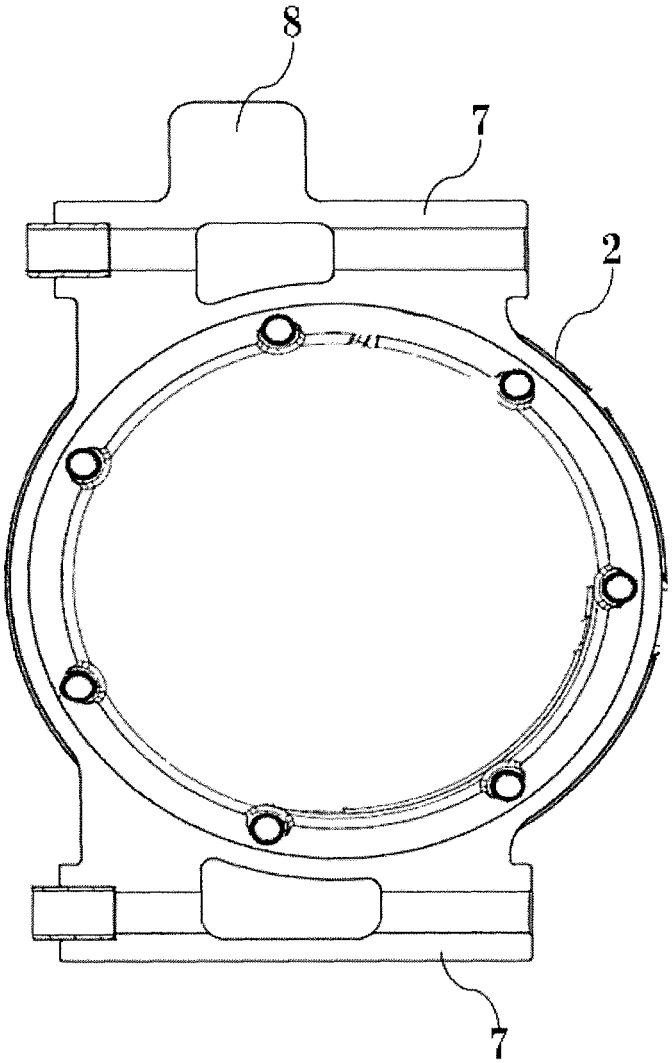
FIG. 5 is a schematic sectional view of the swash plate compressor taken along a cut line A-A depicted in FIG. 1 and FIG. 2, according to one embodiment of the present invention.

In particular, in the embodiment of the present invention depicted in FIG. 1, FIG. 2, and FIG. 4, as a part of the compressor-attachment mount portion 7, the blocking portion 8 is integrally formed with the front housing 2 by using the same material. For description of the shape of the blocking portion 8 in more detail, a schematic sectional view thereof in an A-A cut line depicted in FIG. 1 and FIG. 2 is depicted in FIG. 5. As evident from these, it is preferable that a flat plate member be externally provided and formed as the blocking portion 8 as a part of the compressor-attachment mount portion 7.

Figure 6:
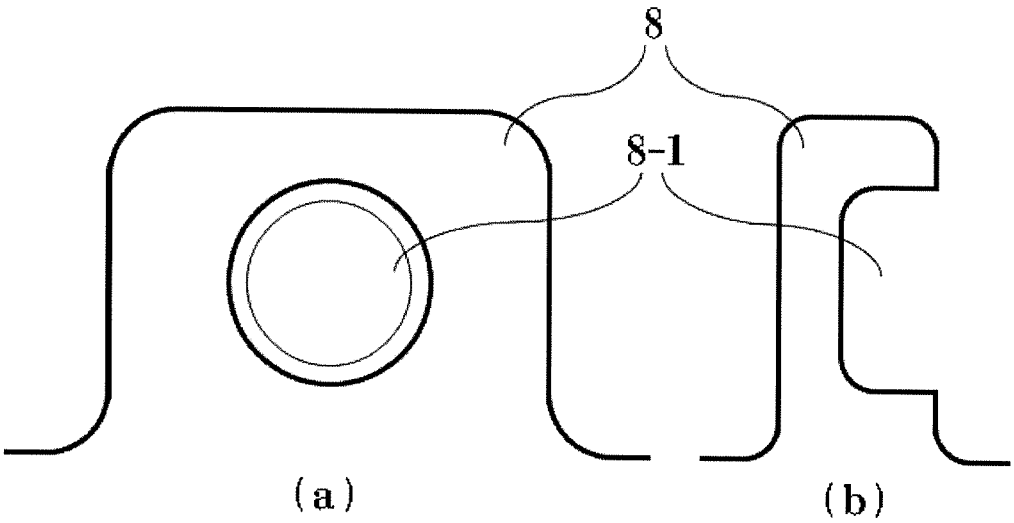
FIG. 6 is a diagram depicting a shape of a plate member having a concave part which functions as a blocking portion according to one embodiment of the present invention, where (a) is a front view and (b) is a sectional view.

Furthermore, by providing a concave part 8-1 substantially centering at a point where the flat portion of the plate member of the blocking portion 8 and the ejection direction line B cross, dispersion of the refrigerant containing lubricating oil can be inhibited when colliding with the blocking portion 8. This is more preferable because of enhancing the effect of preventing ejection of the refrigerant containing lubricating oil to the I direction in which the drive belt, the pulley, and the electromagnetic clutch are provided, also enhancing the effect of precipitating the lubricating oil by the collision of the refrigerant containing lubricating oil with the blocking portion 8, and decreasing the refrigerant containing lubricating oil diverging to the II direction in the rear of the compressor where the exhaust manifold is provided. One example of its specific shape is depicted in FIG. 6. A part of FIG. 6 is an enlarged front view of only the blocking portion 8, and a part (b) of FIG. 6 is an enlarged sectional view thereof.

Figure 7:
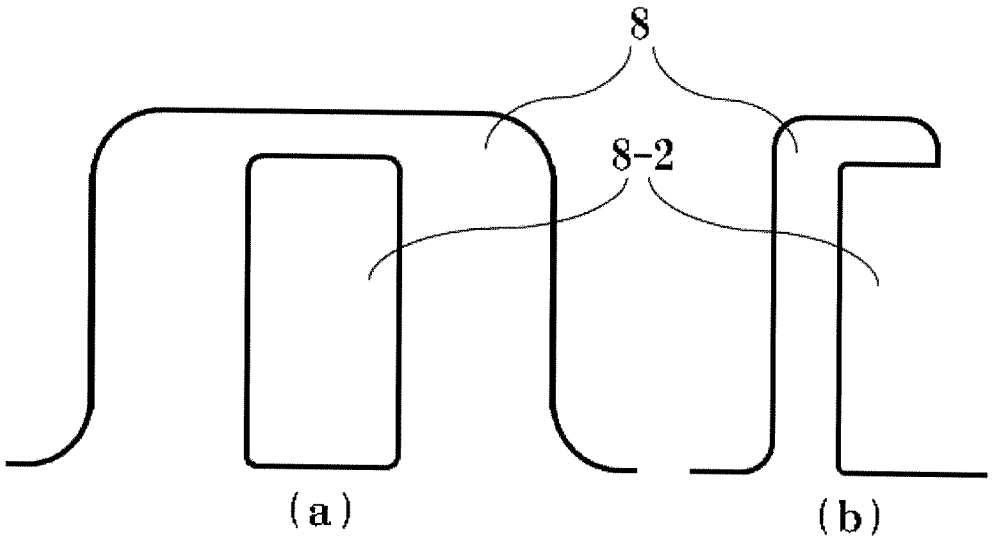
FIG. 7 is a diagram depicting a shape of a plate member having a groove part which functions as a blocking portion according to one embodiment of the present invention, where (a) is a front view and (b) is a sectional view.

Also, by providing a groove part 8-2 in a substantially rectangular-parallelepiped shape and substantially centering at the point where the flat portion of the plate member of the blocking portion 8 and the ejection direction line B cross, in addition to the effects by the shape of the concave part 8-1 described above, the groove part 8-2 can guide the lubricating oil precipitated by the collision of the refrigerant containing lubricating oil with the blocking portion 8 to a portion below the swash plate compressor 1. This is further more preferable because of preventing an outflow of the lubricating oil to various directions. One example of its specific shape is depicted in FIG. 7. A part (a) of FIG. 7 is an enlarged front view of only the blocking portion 8, and a part (b) of FIG. 7 is an enlarged sectional view thereof.

These concave part 8-1 and groove part 8-2 can be applied to the flat portion of the blocking portion 8 of various embodiments described below, and these shapes are not limited to those depicted in FIG. 6 and FIG. 7.

On the other hand, in view of productivity of the swash plate compressor 1 including the blocking portion 8 as a member for processing the refrigerant containing lubricating oil ejected from the ejection port 11 of the safety relief valve 10, a manufacturing method allowing the front housing 2 and the blocking portion 8 to be integrally formed is exceptionally excellent in productivity with less processes because this method is provided to the swash plate compressor 1 without requiring a component attachment process or fixing process as described in the related art or an inspection process for confirming attachment or fixation.

According to this method of manufacturing the blocking portion 8, the blocking portion 8 can be formed of the same material as that of the front housing 2. In particular, as a member requiring resistance to high temperatures, high pressure, and abrasion such as a housing of a compressor, a cast made of aluminum or an aluminum alloy is preferable. As a matter of course, the blocking portion 8 is also a cast made of aluminum or an aluminum alloy. Thus, a blocking portion excellent in durability is formed.

Furthermore, while the safety relief valve 10 is one of a plurality of housing members in the present embodiment, the safety relief valve 10 is attached to the cover 9 on the cylinder block 4 as a housing member different from the front housing 2, and the blocking portion 8 is attached to a housing member different from the front housing 2 integrally formed of the same material. Thus, any order of a process of attaching the safety relief valve 10 to the cover 9 can be set, which enhances flexibility of the manufacturing process. Also, after the front housing 2 with the blocking portion 8 formed therein and the cylinder block 4 with the cover 9 attached thereto are fixed together with the fastening bolt 6, the safety relief valve 10 can be attached to the cover 9. This allows a distance to the blocking portion 8 to be controlled only with the length of the safety relief valve 10.

Furthermore, as for the blocking portion 8, a distance between the ejection port 11 and the blocking portion 8 on the ejection direction line B in which the refrigerant containing lubricating oil is ejected from the ejection port 11 of the safety relief valve 10 is preferably set at 2 mm to 50 mm, more preferably, 2 mm to 15 mm. This positional relation between the ejection port 11 and the blocking portion 8 allows the refrigerant containing lubricating oil ejected from the ejection port 11 to be efficiently captured, thereby enhancing an effect of preventing diffusion of the refrigerant containing lubricating oil to the I direction in which the drive belt, the pulley, and the electromagnetic clutch are provided and also an effect of precipitation of the lubricating oil due to the collision of the refrigerant containing lubricating oil with the blocking portion 8 and decreasing the refrigerant containing lubricating oil diverged to the II direction in the rear of the compressor where the exhaust manifold is provided.

Figure 8:
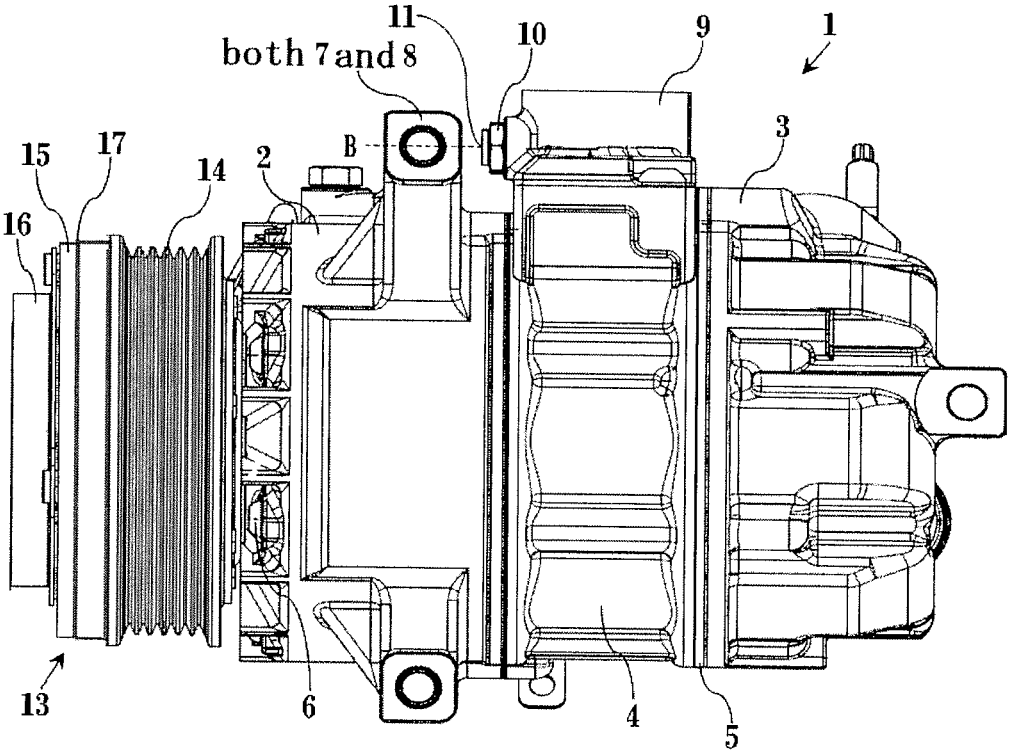
FIG. 8 is a schematic side view of a swash plate compressor formed so that a compressor-attachment mount portion serves also as a blocking portion, according to one embodiment of the present invention.
Figure 9:
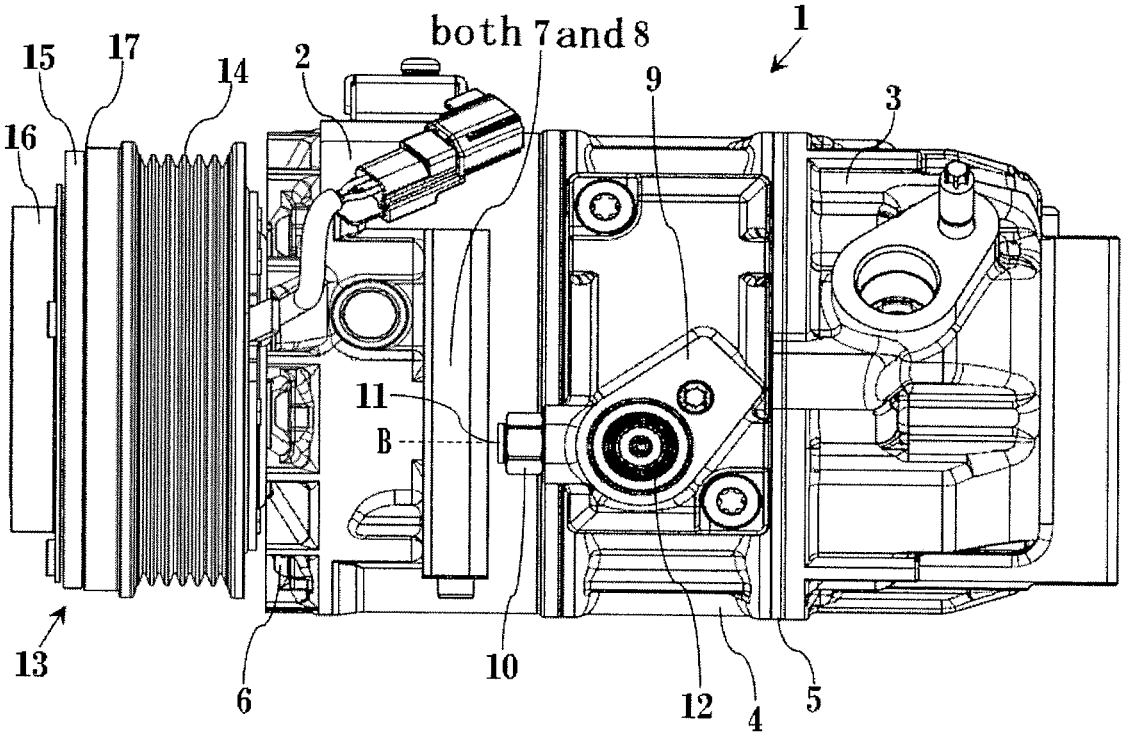
FIG. 9 is a schematic plan view of the swash plate compressor formed so that a compressor-attachment mount portion serves also as a blocking portion, according to one embodiment of the present invention.

FIG. 8 is a schematic side view of the swash plate compressor 1 formed so that the compressor-attachment mount portion 7 serves also as the blocking portion 8, according to one embodiment of the present invention, and FIG. 9 is a schematic plan view thereof. In this example, the compressor-attachment mount portion 7 is disposed on the ejection direction line B in which the refrigerant is ejected from the ejection port 11 of the safety relief valve 10, thereby allowing the compressor-attachment mount portion 7 to exert the function of the blocking portion 8. Details of this positional relation between the compressor-attachment mount portion 7 and the ejection port 11 of the safety relief valve 10 are as depicted in FIG. 1, FIG. 2 and FIG. 4. Similarly, the flat portion of the compressor-attachment mount portion 7 is preferably provided with the concave part 8-1 depicted in FIG. 6A and FIG. 6B or the groove part 8-2 depicted in FIG. 7A and FIG. 7B, and the distance between the compressor-attachment mount portion 7 and the ejection port 11 is preferably 2 mm to 50 mm, more preferably, 2 mm to 15 mm. The same goes for the following embodiments.

Although not depicted herein, the front housing 2 can be molded so that the plate-shaped blocking portion 8 is internally formed on the ejection direction line B in which the refrigerant is ejected from the ejection port 11 of the compressor-attachment mount portion 7 depicted in FIG. 8 and FIG. 9.

Figure 10:
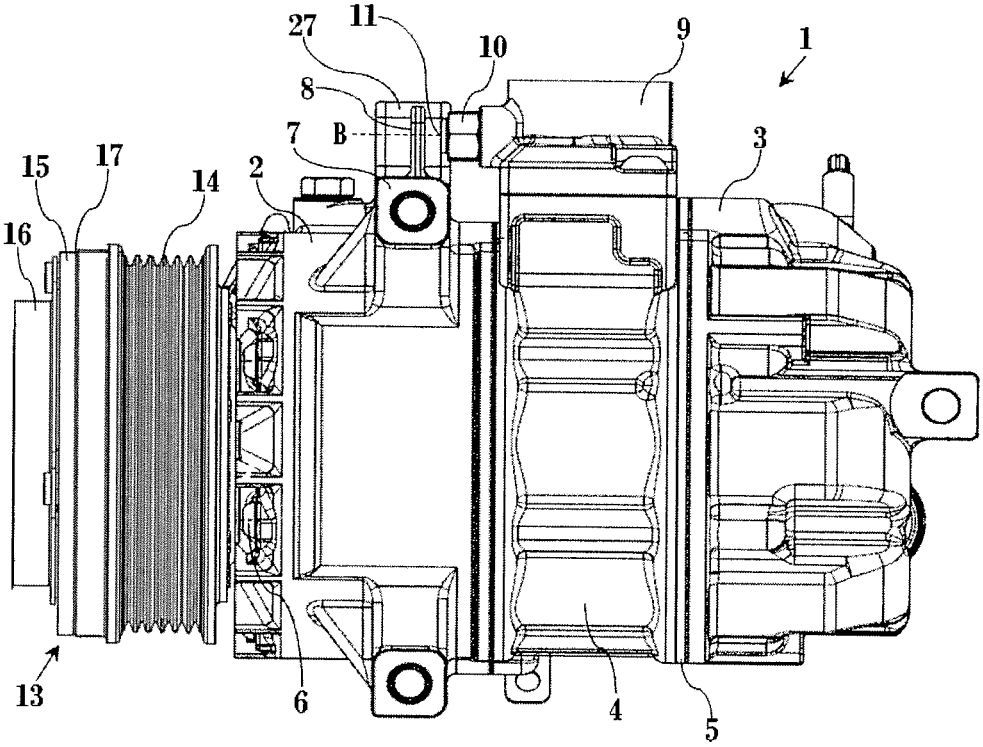
FIG. 10 is a schematic side view of a swash plate compressor formed to have a plate member as a blocking portion internally provided in a part of a gripping portion which grips the compressor on a compressor-attachment mount portion, according to one embodiment of the present invention.
Figure 11:
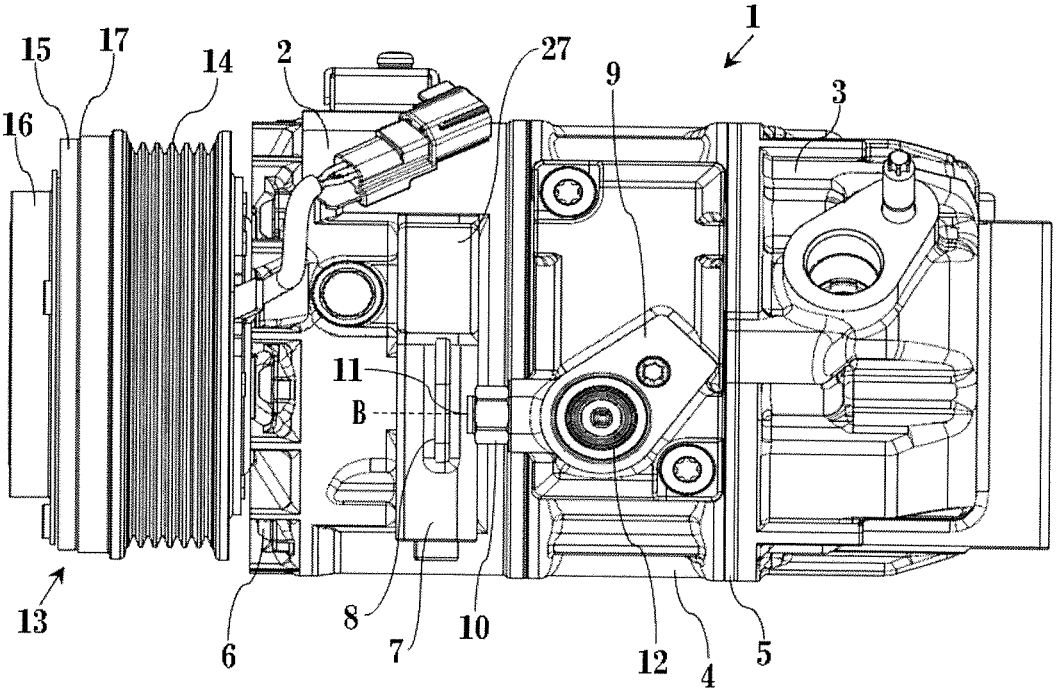
FIG. 11 is a schematic plan view of the swash plate compressor formed to have a plate member as a blocking portion internally provided in a part of a gripping portion which grips the compressor on a compressor-attachment mount portion, according to one embodiment of the present invention.

FIG. 10 is a schematic side view of the swash plate compressor 1 formed to have a plate member as the blocking portion 8 internally provided in a part of a gripping portion 27 which grips the compressor on the compressor-attachment mount portion 7, according to one embodiment of the present invention, and FIG. 11 is a schematic plan view thereof. In this manner, in view of manufacture and attachment to a vehicle, it is preferable to further include the gripping portion 27 integrally formed with the front housing 5 of the swash plate compressor 1 by using the same material to easily grip the swash plate compressor 1 or the front housing 5. In this example, this gripping portion 27 is used to form the blocking portion 8 as being internally provided thereto. The gripping portion 27 may have, for example, a hole or the like, on which a cord or hook can be hooked. Also in this structure, effects similar to those of the embodiments depicted in FIG. 1, FIG. 2 and FIG. 4 can be achieved. While the gripping portion 27 and the blocking portion 8 are formed on the compressor-attachment mount portion 7 in FIG. 10 and FIG. 11, they may be integrally formed with the front housing 2 other than the compressor-attachment mount portion 7 by using the same material, or the compressor-attachment mount portion 7 may not be provided.

FIG. 12 is a schematic side view of the swash plate compressor 1 formed so that the gripping portion 27 which grips the compressor on the compressor-attachment mount portion 7 serves also as the blocking portion 8, according to one embodiment of the present invention, and FIG. 13 is a schematic plan view thereof. Also in this embodiment, as with FIG. 11 and FIG. 12, the gripping portion 27 is further provided which is integrally formed with the front housing 5 of the swash plate compressor 1 by using the same material to easily grip the swash plate compressor 1 or the front housing 5, and the positional relation between the blocking portion 8 and the ejection port 11 depicted in FIG. 1, FIG. 2, and FIG. 4 is applied to this gripping portion 27 for use as it is as the blocking portion 8. Molding of the front housing 2 in the present embodiment is easier than that in the above-described embodiment. Also in the present embodiment, the gripping portion 27 may be integrally formed with the front housing 2 other than the compressor-attachment mount portion 7 by using the same material, or the compressor-attachment mount portion 7 may not be provided.

As has been described in the foregoing, a blocking portion as a member for preventing a refrigerant containing an inflammable component such as lubricating oil ejected from a safety relief valve from diffusing to a direction of a drive belt, a pulley, and an electromagnetic clutch is not separately attached but can be integrally molded with a housing of a compressor. Thus, the invention has a feature in a production process that a component dedicated to the blocking portion or the like is not required and an inspection process for confinning completion of attachment and an attachment direction is not required, either. Thus, the blocking portion is formed of the same material as that of the housing, and is excellent in durability. Also, in the present invention, the refrigerant containing the inflammable component is not guided to one direction, but ejection to a specific direction is blocked to prevent, for example, rotation failure of the drive belt and the pulley for driving the compressor and its auxiliaries and engagement failure between an armature plate and the pulley of the compressor. Also, precipitation of the inflammable component due to the collision of the refrigerant containing the inflammable component with the blocking portion is promoted to decrease the concentration of the refrigerant containing the inflammable component diverging to the rear of the compressor to prevent an occurrence of white smoke due to a contact between the exhaust manifold at high temperatures and the refrigerant, thereby retaining a comfortable vehicle interior space. Therefore, the present invention can provide a compressor excellent in productivity, durability, and safety.

While the swash plate compressor 1 is used as an example of a compressor in the above-described embodiments, the blocking portion of the present invention can be applied also to another compressor having a safety relief valve.

Although the present invention has been described in connection with the preferred embodiments, the invention is not limited thereto. It will be easily understood by those of ordinary skill in the art that variations and modifications can be easily made within the scope of the invention as defined by the appended claims. For example, although what has been detailed in the above-mentioned embodiment has an assumption of a safety relief valve used in a composition in which an internal-combustion engine like an electromagnetic clutch is utilized as motive power for a compressor, the present invention can also be applied to a safety relief valve which is used in an electric compressor driven by a motor, or a hybrid engine.

What is claimed is:

1. A compressor comprising:

a compression mechanism capable of compressing a working fluid, the compression mechanism being driven by one of the following means: motive power from an internal-combustion engine, an electric motor, or motive power from a hybrid engine;

a low-pressure region directly or indirectly connected to the compression mechanism, the low-pressure region being a space in which the working fluid is supplied to the compression mechanism;

a high-pressure region directly or indirectly connected to the compression mechanism, the high-pressure region being a space to which the working fluid compressed by the compression mechanism is discharged;

a housing having directly or indirectly accommodated therein the compression mechanism, the low-pressure region, and the high-pressure region, the housing forming a space in which the working fluid can be accommodated, the housing including a plurality of housing members;

a safety relief valve attached to at least one of the plurality of housing members, the safety relief valve having an ejection port from which the working fluid accommodated in the space formed by the at least one of the plurality of housing members can be released to the outside of the housing toward at least one ejection direction; and a blocking portion having a surface disposed opposite to the ejection direction or a surface disposed so as to form a predetermined angle with respect to the ejection direction, wherein the blocking portion is integrally formed with any one of the plurality of housing members by using a material identical to a material of the one of the plurality of housing members.

2. The compressor according to claim 1, wherein the blocking portion is disposed on the at least one of the plurality of housing members.

3. The compressor according to claim 1, wherein the safety relief valve is attached to a housing member different from the one of the plurality of housing members where the blocking portion is formed.

4. The compressor according to claim 1, further comprising a mount portion for attaching the compressor, the mount portion integrally formed with any one of the plurality of housing members by using a material identical to a material of the one of the plurality of housing members, wherein the mount portion is formed as the blocking portion.

5. The compressor according to claim 1, further comprising a mount portion for attaching the compressor, the mount portion integrally formed with any one of the plurality of housing members by using a material identical to a material of the one of the plurality of housing members, wherein the blocking portion is formed as a part of the mount portion.

6. The compressor according to claim 1, further comprising a mount portion for attaching the compressor, the mount portion integrally formed with any one of the plurality of housing members by using a material identical to a material of the one of the plurality of housing members, wherein the blocking portion is formed as being externally attached to the mount portion.

7. The compressor according to claim 1, further comprising a mount portion for attaching the compressor, the mount portion integrally formed with any one of the plurality of housing members by using a material identical to a material of the one of the plurality of housing members, wherein the blocking portion is formed as being internally attached to the mount portion.

8. The compressor according to claim 1, further comprising:

a mount portion for attaching the compressor, the mount portion integrally formed with any one of the plurality of housing members by using a material identical to a material of the one of the plurality of housing members; and a gripping portion on the mount portion to grip the compressor, wherein the gripping portion is formed as the blocking portion.

9. The compressor according to claim 1, further comprising:

a mount portion for attaching the compressor, the mount portion integrally formed with any one of the plurality of housing members by using a material identical to a material of the one of the plurality of housing members; and a gripping portion on the mount portion to grip the compressor, wherein the blocking portion is formed as being internally attached to the gripping portion.

10. The compressor according to claim 1, wherein the blocking portion substantially as a whole is formed as a plate member which crosses a line coaxial in the ejection direction.

11. The compressor according to claim 1, wherein the blocking portion has a concave part formed at a portion opposite to the ejection port.

12. The compressor according to claim 1, wherein the blocking portion has a groove part formed at a portion opposite to the ejection port.

13. The compressor according to claim 1, wherein a distance between the ejection port and the blocking portion on a line coaxial in the ejection direction is from substantially 2 mm to substantially 50 mm.

14. The compressor according to claim 1, wherein the blocking portion is integrally formed with any one of the plurality of housing members by using a material identical to a material of the one of the plurality of housing members, and the material is aluminum or an aluminum alloy.

* * * * *